US008693703B2

(12) United States Patent
Rung

(10) Patent No.: US 8,693,703 B2
(45) Date of Patent: Apr. 8, 2014

(54) METHOD OF COMBINING AT LEAST TWO AUDIO SIGNALS AND A MICROPHONE SYSTEM COMPRISING AT LEAST TWO MICROPHONES

(75) Inventor: Martin Rung, Bronshoj (DK)

(73) Assignee: GN Netcom A/S (DK)

( * ) Notice: Subject to any disclaimer, the term of this patent is extended or adjusted under 35 U.S.C. 154(b) by 603 days.

(21) Appl. No.: 12/989,916

(22) PCT Filed: May 2, 2008

(86) PCT No.: PCT/DK2008/000170
§ 371 (c)(1),
(2), (4) Date: Jan. 26, 2011

(87) PCT Pub. No.: WO2009/132646
PCT Pub. Date: Nov. 5, 2009

(65) Prior Publication Data
US 2011/0044460 A1 Feb. 24, 2011

(51) Int. Cl.
*H04R 3/00* (2006.01)

(52) U.S. Cl.
USPC ..... 381/92; 381/94.2; 381/94.3; 381/58; 381/122; 381/74; 367/121; 367/123; 704/233

(58) Field of Classification Search
USPC ..... 381/92, 94.2, 94.3, 94.7, 71.1, 370, 381/375, 390, 58, 122, 74; 367/121, 123, 367/125, 126, 127, 129; 704/226, 233
See application file for complete search history.

(56) References Cited

U.S. PATENT DOCUMENTS 5,473,701 A * 12/1995 Cezanne et al. ..... 381/92
6,888,949 B1 5/2005 Vanden Berghe et al.

(Continued)

FOREIGN PATENT DOCUMENTS

EP 0652686 10/1994
EP 1251493 10/2002
JP 2006217649 8/2006

OTHER PUBLICATIONS

International Search Report for PCT/DK2008/000170.

(Continued)

*Primary Examiner* — Vivian Chin
*Assistant Examiner* — Friedrich W Fahnert
(74) *Attorney, Agent, or Firm* — Altera Law Group, LLC

(57) ABSTRACT

A method of combining at least two audio signals for generating an enhanced system output signal is described. The method comprises the steps of: a) measuring a sound signal at a first spatial position using a first transducer, such as a first microphone, in order to generate a first audio signal comprising a first target signal portion and a first noise signal portion, b) measuring the sound signal at a second spatial position using a second transducer, such as a second microphone, in order to generate a second audio signal comprising a second target signal portion and a second noise signal portion, c) processing the first audio signal in order to phase match and amplitude match the first target signal with the second target signal within a predetermined frequency range and generating a first processed output, d) calculating the difference between the second audio signal and the first processed output in order to generate a subtraction output, e) calculating the sum of the second audio signal and the first processed output in order to generate a summation output, f) processing the subtraction output in order to minimise a contribution from the noise signal portions to the system output signal and generating a second processed output, and g) calculating the difference between the summation output and the second processed output in order to generate the system output signal.

26 Claims, 3 Drawing Sheets

(56) References Cited

U.S. PATENT DOCUMENTS

| | | | | |
|---|---|---|---|---|
| 7,206,421 | B1 | 4/2007 | Taenzer | |
| 2002/0176589 | A1* | 11/2002 | Buck et al. | 381/94.7 |
| 2003/0108214 | A1* | 6/2003 | Brennan et al. | 381/94.7 |
| 2007/0036386 | A1* | 2/2007 | Amae | 381/388 |
| 2007/0086602 | A1* | 4/2007 | Petersen et al. | 381/92 |
| 2007/0127753 | A1* | 6/2007 | Feng et al. | 381/313 |
| 2007/0183610 | A1* | 8/2007 | Kidmose | 381/313 |
| 2008/0152167 | A1* | 6/2008 | Taenzer | 381/94.2 |
| 2008/0260175 | A1* | 10/2008 | Elko | 381/73.1 |

OTHER PUBLICATIONS

Vanden Berghe Jeff et al.: "An adaptive noise canceller for hearing aids using two nearby microphones", Journal of the Acoustical Society of America, Melville, NY, US vol. 103, No. 6, Jun. 1, 1998, pp. 3621-3626.

* cited by examiner

METHOD OF COMBINING AT LEAST TWO AUDIO SIGNALS AND A MICROPHONE SYSTEM COMPRISING AT LEAST TWO MICROPHONES

TECHNICAL FIELD

The present invention relates to a method of combining at least two audio signals for generating an enhanced system output signal. Furthermore, the present invention relates to a microphone system having a system output signal and comprising: a first microphone for collecting sound and arranged at a first spatial position, the first microphone having a first audio signal as output, the first audio signal comprising a first target signal portion and a first noise signal portion, and a second microphone for collecting sound and arranged at a second spatial position, the second microphone having a second audio signal as output, the second audio signal comprising a second target signal portion and a second noise signal portion. Finally, the present invention relates to a headset utilising said method or comprising said microphone system.

BACKGROUND

The popularity of wireless communication devices, such as mobile phones and Blue-tooth™ headsets, has over the last years grown significantly, amongst other things due to these types of communication devices being transportable, which means that they can be used virtually anywhere. Therefore, such communication devices are often used in noisy environments, the noise relating to for instance other people talking, traffic, machinery or wind noise. Consequently, it can be a problem for a far-end receiver or listener to separate the voice of the user from the noise.

It is well-known within the art to use a directional microphone to minimise the problems from noise. Such directional microphones have a varying sensitivity to noise as a function of the angle from a given source, this often being referred to as a directivity pattern. The directivity pattern of such a microphone is often provided with a number of directions of low sensitivity, also called directivity pattern nulls, and the directional pattern is typically arranged so that a direction of peak sensitivity is directed towards a desired sound source, such as a user of the directional microphone, and with the directivity pattern nulls directed towards the noise sources. Thereby, it is possible to maximise a voice-to-background-noise or signal-to-noise ratio of systems using such a directional microphone.

EP 0 652 686 discloses an apparatus of enhancing the signal-to-noise ratio of a microphone array, in which the directivity pattern is adaptively adjustable.

U.S. Pat. No. 7,206,421 relates to a hearing system beamformer and discloses a method and apparatus for enhancing the voice-to-background-noise ratio for increasing the understanding of speech in noisy environments and for reducing user listening fatigue.

DISCLOSURE OF THE INVENTION

The purpose of the present invention is to provide an improved method and system for enhancing a system output signal by combining at least two audio signals.

According to a first aspect of the invention, this is obtained by a method comprising the steps of: a) measuring a sound signal at a first spatial position using a first transducer, such as a first microphone, in order to generate a first audio signal comprising a first target signal portion and a first noise signal portion, b) measuring the sound signal at a second spatial position using a second transducer, such as a second microphone, in order to generate a second audio signal comprising a second target signal portion and a second noise signal portion, c) processing the first audio signal in order to phase match and amplitude match the first target signal with the second target signal within a predetermined frequency range and generating a first processed output, d) calculating the difference between the second audio signal and the first processed output in order to generate a subtraction output, e) calculating the sum of the second audio signal and the first processed output in order to generate a summation output, f) processing the subtraction output in order to minimise a contribution from the noise signal portions to the system output signal and generating a second processed output, and g) calculating the difference between the summation output and the second processed output in order to generate the system output signal.

Steps a)-c) are directed towards picking up sound from an intended or target sound source. Thus, the target signal portions of the first and second audio signals may for instance relate to the speech signals from a user of a microphone system utilising this method. The processing of the first audio signal in step c) ensures a substantial exact matching, i.e. both a phase and amplitude matching, of the first target signal portion and the second target signal portion with a predetermined frequency range. This predetermined frequency range may for instance again relate to the speech signals of the user. By ensuring a substantially exact matching of the two target signal portions, it is ensured that the target signal portions are cancelled out and not carried on to the subtraction output of step d). Thus only the contribution from the noise portions (or the unintended parts) of the audio signals to the system output is minimised during the processing of the subtraction output in step f). Further, it is ensured that the target portions appear maximally in the summation output from step e) due to constructive interference, whereas the noise signal portions (or unintended parts) of the audio signals in some cases may be averaged out, since they are not necessarily matched. This especially is the case for uncorrelated noise, such as wind noise.

The method makes it possible to attenuate background noise 3-12 dB (or even more) depending on the direction and directionality of the noise. The second microphone may also or instead be filtered during step c) in order to match the target signal portions of the audio signals.

The method is particularly suitable for communication systems, such as a headset, where the spatial position of the source of the target sound signal, i.e. the speech signal from the user of the headset, is well defined and close to the first microphone and the second microphone. In this case, the geometry of the microphones and the target sound source or speech source remain relatively constant, even when the headset user is moving around. Accordingly, the frequency dependent phase and amplitude matching of the target signal portions in step c) can be carried out with high precision. Furthermore, it is expected that a certain pre-learned (or pre-calibrated) phase and amplitude matching is accurate in many situations, e.g., as the headset user is moving around. Since the target sound source is positioned close to the microphones, even small variations in the propagation distance from the source of the target sound signal to the first and second microphone, respectively, may have a relatively high effect on the amplitude and phase of the target sound signal. Furthermore, the microphones may have different sensitivities. Therefore, it is a necessary component of the system to match the phases and amplitudes of the two target signal portions in step c) in order to compensate for the variations in propagation lengths and microphone sensitivities.

This also means that undesired noise sources are run through the same amplitude matching, thereby making the noise signal portions even more predominant in the subtraction output. However, this only makes it easier to minimise the contribution from the noise in step f).

The transducers may include a pre-amplifier and/or an ND-converter. Thus the output from the first and the second transducer may be either analogue or digital.

According to a preferred embodiment, the processing of the subtraction output is carried out by matching the noise signal portions of the subtraction output to the noise signal portions of the summation output. Thus, the noise signal portion of the subtraction output cancels out the noise signal portion of the summation output in step g), since the subtraction output is subtracted from the summation output.

According to a preferred embodiment, the processing of the subtraction output in step f) is controlled via the system output signal, for instance by minimising the noise signal portion of the system output signal via a negative feedback loop, which may be iterative, if the system is digital. In another preferred embodiment, the processing of the subtraction output is in step f) carried out by regulating a directivity pattern. Thereby, angular directions of low sensitivities, e.g. directivity pattern nulls, may be directed towards the source of noise, thus minimising the contribution from this source to the system output signal.

Preferably, the first audio signal is processed using a frequency dependent spatial matching filter, thus compensating for both phase variations and amplitude variations as a function of the frequency within the predetermined frequency range.

According to an advantageous embodiment according to the invention, the spatial matching filter is adapted for matching the first target signal portion with the second target signal portion towards a target point in a near field of the first microphone and the second microphone, this target point for instance being the mouth of a user. According to another advantageous embodiment, the distance between the target point and the first and second microphone, respectively, is 15 cm or less. The distance may also be 10 cm or less.

Typically, the spatial matching filter is pre-calibrated for the particular system in which it is to be used, since the particular mutual spatial positions of the first microphone and second microphone are both system and user dependent and the matching between the target signal portions has to be substantially exact both with respect to amplitude and phase within the predetermined frequency range. The pre-calibration can be carried out via simulations or calibration measurements.

According to yet another advantageous embodiment of the invention, the subtraction output, in step f), is filtered using a bass-boost filter. The bass-boost provides a helpful pre-processing operation in step f), since the subtraction of two low-frequent signals, which are nearly in-phase, yields a relatively low-powered signal. Conversely, the difference between two high-frequent signals has approximately the same power as the signals themselves. Therefore, a bass-boost filter can be used to match the power of the difference channel to the power of the sum channel, at least within the predetermined frequency range. The required frequency response of the bass-boost filter is dependent on the spatial distance between the first microphone and the second microphone, and the distance to the target point.

In one embodiment according to the invention, the subtraction output, during step f), is phase shifted with a frequency dependent phase constant. By choosing a correct phase constant, the processing in step f) can be carried out much simpler, since the adaptive parameter, which is utilised to regulate the directivity pattern, can be kept real. Otherwise the adaptive parameter becomes complex, which complicates the optimisation of the directivity pattern significantly. Since the method will often be employed in a near-field system, the filters need to be pre-calibrated via measurements or simulations in order to achieve the optimum frequency dependent phase constant. In systems, where the target signal is in the far-field and the microphones exhibit an exact omnidirectional directivity pattern, it is possible to use a constant phase filter, e.g. shifting all frequencies pi/2 in phase.

According to another embodiment, the summation output prior to step g) is multiplied with a multiplication factor. Preferably, this multiplication factor equals 0.5 in order for the output to be the mean value of the first audio signal and the second audio signal. Thereby, the summation output and the subtraction output are correspondingly weighted prior to carrying out step g).

According to yet another embodiment the first audio signal is weighted with a first weighting constant and the second audio signal is weighted with a second weighting constant in step e). Preferably, the first weighting coefficient and the second coefficient sum to unity. In some cases it may be preferred to use different weighting coefficients for the two audio signals. If the noise for instance is more powerful at the first microphone than at the second microphone, then it is useful to set the second weighting coefficient higher, e.g. to 0.9, and the first weighting coefficient lower, e.g. to 0.1.

According to a preferred embodiment, the subtraction output is regulated using a least mean square technique, i.e. the quadratic error between the summation output and the subtraction output is minimised, using a stochastic gradient method. The minimisation may be performed using a normalised least mean square technique.

The minimisation of the contribution from the noise signal portions may be carried out according to the following algorithms, where the system output Sout is defined as:

$$Sout = Z_s - K^{(n)} \cdot Z_d$$

where $Z_s$ and $Z_d$ are the complex signals corresponding to the summation output and the second processed output, respectively. The signals are complex (rather than real) due to the fact that they are the outputs of discrete Fourier transforms of the signals. Thus, the above equation implies a frequency index, which is omitted for simplicity of notation. $K^{(n)}$ is a real parameter that is varied or adapted in step f), where n is the algorithm iteration index.

On the n'th iteration of the algorithm, $K^{(n)}$ is updated according to the following scheme using an auxiliary parameter $\tilde{K}^{(n)}$:

$$\tilde{K}^{(n)} = K^{(n-1)} + \gamma \frac{\mathrm{Re}\{Sout^* \cdot Z_d\}}{|Z_d|^2 + \alpha}$$

$$K^{(n)} = \begin{cases} K_{max} & \tilde{K}^{(n)} > K_{max} \\ K_{min} & \tilde{K}^{(n)} < K_{min} \\ \tilde{K}^{(n)} & \text{otherwise} \end{cases}$$

where Re denotes the real part and * denotes the complex conjugate. The optional small constant $\alpha$ is added for increased robustness of the algorithm, which helps when $Z_d$ is small. The step-size, $\gamma$, determines the speed of adaptation. $K^{(n)}$ is limited to a range, where $K_{min}$ and $K_{max}$ are predetermined values that limit the angular direction of directivity pattern nulls and prevent these nulls from being located in certain regions of space. Specifically, the nulls may be prevented from being directed towards the mouth position of a user utilising a system employing the method.

It should be noted that the above iterations are carried out for each frequency index of the signals, the individual frequency indexes corresponding to a particular frequency band of the Discrete Fourier Transformation.

According to another aspect of the invention, the purpose is achieved by a microphone system of the afore-mentioned art, wherein the system further comprises: a first processing means for phase matching and amplitude matching the first target signal portion to the second target signal portion within a predetermined frequency range, the first processing means having the first audio signal as input and having a first processed output, a first subtraction means for calculating the difference between the second audio signal and the first processed output and having a subtraction output, a summation means for calculating the sum of the second audio signal and the first processed output and having a summation output, a first forward block having a first forward output and having the summation output as input, a second forward block having the subtraction output as input and having a second processed output, the second forward block being adapted for minimising a contribution from the noise signal portions to the system output, a second subtraction means for calculating the difference between the first forward output and the second processed output and having the system output signal (Sout) as output.

Thus, the previously mentioned step c) is carried out by the first processing means, and the second forward block carries out step f). Thereby, the invention provides a system, which is particularly suited for collecting sound from a target source at a known spatial position in the near-field of the first and the second microphone and at the same time suitable for minimising the contribution from any other sources to the system output signal. The first forward block is also called the summation channel, and the second forward block is also called the difference channel.

In a preferred embodiment according to the invention, the second forward block comprises an adaptive block, which is adapted for regulating a directivity pattern. Thereby, the system may be adapted for directing directivity pattern nulls towards the noise sources. Preferably, the second forward block, or more particularly the adaptive block, is controlled via the system output signal (Sout). This control can for instance be handled via a negative feedback. The feedback may be iterative, if the system is digital.

According to an advantageous embodiment, the second forward block is controlled using a least mean square technique, i.e. minimisation of a quadratic error between the first forward output (from the summation channel) and the second processed output (from the difference channel) using a stochastic gradient method. The least mean square technique may be normalised.

In one embodiment according to the invention, the first microphone and/or the second microphone are omni-directional microphones. This provides simple means for beamforming and generating a directivity pattern of the microphone system.

According to another advantageous embodiment of the microphone system, the first processing means comprises a frequency dependent spatial matching filter. Thus, as a function of the frequency the processing means may compensate for different sensitivities of the first microphone and second microphone and phase differences of signals from the target source, e.g. a user of a headset.

According to yet another advantageous embodiment, the second forward block comprises a bass-boost filter. Thereby, the low-powered low-frequency signals of the subtraction channel are so to speak matched to the summation channel.

In another embodiment according to the invention, the second forward block comprises a phase shift block for phase shifting the output from the first subtraction means. Preferably the phase is shifted with a frequency dependent phase constant. By choosing a correct phase constant, the processing in step f) can be carried out much simpler, since the parameter K, which is utilised to regulate the directivity pattern would otherwise be complex, which would complicate the optimisation of the directivity pattern.

In another embodiment according to the invention, the first forward block comprises a multiplication means for multiplying the summation output with a multiplication factor. Preferably, this multiplication factor equals 0.5 in order for the output to be the mean value of the first audio signal and the second audio signal. Alternatively, the first audio signal and the second audio signal are weighted using a first weighting constant and a second weighting constant, respectively. Preferably, the first weighting constant and the second weighting sum to unity.

According to an alternative embodiment, the first forward block comprises only an electrical connection, such as a wire, so that the first forward input corresponds to the summation output. Instead the subtraction output may be appropriately scaled in order to correspondingly weigh the summation output and the subtraction output before being input to the second subtraction means.

According to yet another aspect, the invention provides a headset comprising at least a first speaker, a pickup unit, such as a microphone boom, and a microphone system according to any of the previously described embodiments, the first microphone and the second microphone being arranged at, on, or within the pickup unit. Thereby, a headset having a high voice-to-noise ratio is provided. The matching of the first target signal portion and the second target signal portion can be carried out with high precision due to the relatively fixed position of the user's mouth relative to the first and second microphone.

According to a first embodiment of the headset, a directivity pattern of the microphone system comprises at least a first direction of peak sensitivity oriented towards the mouth of a user, when the headset is worn by the user. Thereby, the headset is optimally configured to detect a speech signal from the user.

According to an advantageous embodiment of the headset, the directivity pattern comprises at least a first null oriented away from the user, when the headset is worn by the user. Preferably, the orientation of the at least first null is adjustable or adaptable, so that the null can be directed towards a source of noise in order to minimise the contribution from this source of noise to the system output signal. This is carried out via the feedback and the adaptive block.

According to yet another advantageous embodiment, the headset comprises a number of separate user settings for the filter means. The phase and amplitude matching of the first target signal portion and the second target signal portion depend on the particular spatial positions of the two microphones. Therefore, the user settings differ from user to user and should be calibrated beforehand. Also, a given user may have two or more preferred settings for using the headset, e.g. two different microphone boom positions. Therefore, a given user may also utilise different user settings. Alternatively, the headset may be so designed that it is only possible to wear the headset according to a single configuration or setting.

In another embodiment of the headset according to the invention, the headset is adapted to automatically change the user settings based on a position of the pickup unit. Thereby, the headset may automatically choose the user settings, which yield the optimum matching of the first target signal portion and the second target signal portion for a given user and the pickup unit. The headset could in this case be pre-calibrated for a number of different positions of the pickup unit. Accordingly, the headset may extrapolate the optimum setting for positions different from the pre-calibrated positions.

According to another embodiment of the headset, the first microphone and the second microphone are arranged with a mutual spacing of between 3 and 40 mm, or between 4 and 30 mm, or between 5 and 25 mm. The spacing depends on the intended bandwidth. A large spacing entails that it becomes more difficult to match the first target signal portion and the second target signal portion, therefore being more applicable for a narrowband setting. Conversely, it is easier to match the first target signal portion and the second target signal portion, when the spacing is small. However, this also entails that the noise portions of the signals become more predominant. Thus, it may become more difficult to filter out the noise portions from the signals.

A spacing of 20 mm is a typical setting for a narrowband configuration and a spacing of 10 mm is a typical setting for a wideband setting.

Further, it should be noted that the above embodiments are described according to methods and systems employing two microphones. However, methods and systems employing microphone arrays with three, four or even more microphones are also contemplated, for instance by cascading summation and subtraction channels.

Embodiments are here described relating to headsets. However, the different embodiments could also have been other communication equipment utilising the microphone system or method according to the invention.

The invention is explained in detail below with reference to embodiments shown in the drawings, in which

DETAILED DESCRIPTION OF THE INVENTION

Figure 1:
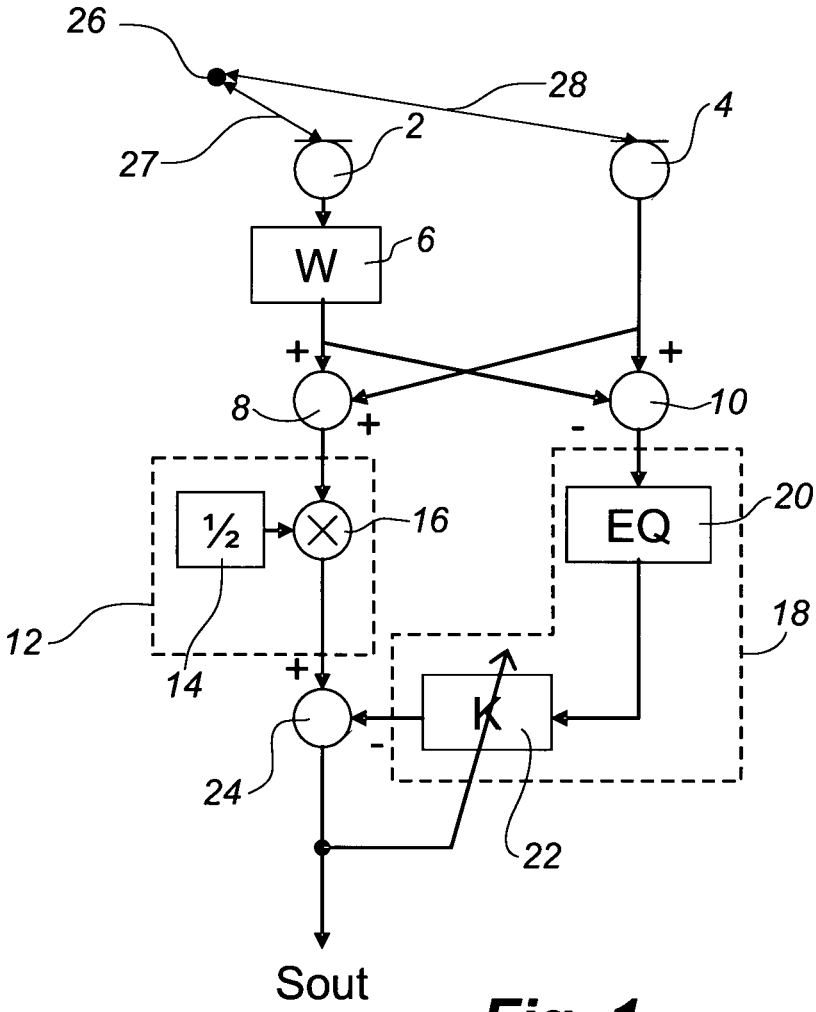
FIG. 1 is a schematic view of a microphone system according to the invention.

FIG. 1 illustrates a microphone system according to the invention. The microphone system comprises a first microphone 2 arranged at a first spatial position and a second microphone 4 arranged at a second spatial position. The first microphone and the second microphone are so arranged that they both can collect sound from a target source 26, such as the mouth of a user of the microphone system.

The first microphone 2 and or the second microphone 4 are adapted for collecting sound and converting the collected sound to an analogue electrical signal. However, the microphones 2, 4 may also comprise a pre-amplifier and/or an ND-converter (not shown). Thus, the output from the microphones can either be analogue or digital depending on the system, in which the microphone system is to be used. The first microphone 2 outputs a first audio signal, which comprises a first target signal portion and a first noise signal portion, and the second microphone 4 outputs a second audio signal, which comprises a second target signal portion and a second noise signal portion. The target signal portions relate to the sound from the target source 26 within a predetermined frequency range, such as a frequency range relating to the speech of a user utilising the microphone system. The noise portions relate to all other unintended sound sources, which are picked up by the first microphone 2 and/or the second microphone 4. The distance between the target source 26 and the first microphone 2 is in the following referred to as the first path length 27, and the distance between the target source 26 and the second microphone 4 is referred to as the second path length 28.

Optimally, the target source 26, the first microphone 2, and the second microphone 4 are arranged substantially on a straight line so that the target source 26 is closer to the first microphone 2 than the second microphone 4.

The first audio signal is fed to a first processing means 6 comprising a spatial matching filter. The first processing means 6 processes the first audio signal and generates a first processed output. The spatial matching filter is adapted to phase match and amplitude match the first target signal portion and the second target signal portion within the predetermined frequency range. The spatial matching filter has to compensate for the difference between the first path length 27 and the second path length 28. The difference in path lengths introduces a frequency dependent phase difference between the two signals. Therefore, the spatial matching filter has to carry out a frequency dependent phase matching, e.g. via a frequency dependent phase shift function. If the target source 26 is located in the near-field of the two microphones 2, 4, even small differences between the first path length 27 and the second path length 28 may influence the sensitivity of the first microphone 2 and the second microphone 4, respectively, to the sound from the target source 26. Further, small inherent tolerances of the microphones may influence the mutual sensitivity. Therefore, the first target signal portion and the second target signal portion also have to be amplitude matched in order to not carry the amplitude difference over to the difference channel, which is described later.

If the first path length 27 and second path length 28 are well defined, it is possible to perform a substantially exact matching of the first target signal portion and the second target signal portion, thereby ensuring that the target signal portions are cancelled out and not carried on to the difference channel, the difference channel thus only carrying the noise signal portions of the signals. This is for instance the situation, if the microphone system is used for a headset or other communication devices, where the mutual positions of the user and the first and second microphone are well defined and substantially mutually stationary.

According to an advantageous embodiment, the first microphone 2 and the second microphone 4 are omni-directional microphones. With such microphones it is easy to design a microphone system having an overall directivity pattern with angle of peak sensitivity and angle of low sensitivities, also called directivity pattern nulls. The overall system sensitivity can for instance easily be made omni-directional, cardioid, or bidirectional.

The first processed output and the second audio signal are summated by a summation means 8, thereby generating a summation output. The summation output is fed to a first forward block 12, also called a summation channel, thereby generating a first forward output.

Furthermore, the difference between the first processed output and the second audio signal is calculated by a first subtraction means 10, thereby generating a subtraction output. The subtraction output is fed to a second forward block 18, also called a difference channel, thereby generating a second processed output. In the difference channel 18, the subtraction output is first fed to a bass-boost filter 20, which may comprise a phase shifting filter. The output from the bass-boost filter 20 (and the optional phase shifting filter) is fed to an adaptive filter 22, the output of which is the second processed output.

The summation output is in the summation channel fed to a multiplication means 16 or multiplicator, where the summation output is multiplied by a multiplication factor 14, and thereby generating the first forward output. In an advantageous embodiment, the multiplication factor equals 0.5, the first forward output thereby being the average of the first processed output and the second audio signal.

Alternatively, the first audio signal can be weighted using a first weighting constant, and the second audio signal can be weighted using a second weighting constant. In this situation the first weighting constant and the second weighting constant should sum to unity. Thus, the shown embodiment, where the summation output is multiplied by a multiplication factor of 0.5, is a specific situation, where the first weighting constant and the second weighting constant both equal 0.5.

Finally, the difference between the first forward output and the second processed output is calculated by a second subtraction means 24, thereby generating a system output signal (Sout). The system output signal is fed back to the adaptive block 22.

The subtraction output is filtered using a bass-boost filter 20 (EQ). The bass-boost amplifies the low-frequent parts of the subtraction output. This may be necessary, since these frequencies are relatively low powered, as low-frequent sound signals incoming to the first microphone 2 and the second microphone 4 are nearly in-phase, since the two microphones are typically arranged close to each other. Conversely, the difference between two high-frequent signals has approximately the same power as the factors of the signals themselves. Therefore, a bass-boost filter may be required to match the power of the difference channel to the power of the sum channel, at least within the predetermined frequency range. The required frequency response of the bass-boost filter is dependent on the spatial distance between the first microphone and the second microphone, and the distance to the target source.

The output from the bass-boost filter is fed to an adaptive block 22, which regulates the overall directivity pattern of the microphone system, in the process also minimising the contribution from the first noise signal portion and the second noise signal portion to the system output signal. As previously mentioned, the adaptive block 22 is controlled by the system output signal, which is fed back to the adaptive block 22. This is carried out by a least mean square technique, where the quadratic error between the output from the summation channel and the difference channel is minimised. In the process, the angular directions of low sensitivities, e.g. directivity pattern nulls, may be directed towards the source of noise, thus minimising the contribution from this source to the system output signal.

According to one example of implementing a digital microphone system, the adaptive block is controlled via the following expressions. The minimisation of the contribution from the noise signal portions is carried out using a least mean square technique according to the following algorithms, where the system output Sout is defined as:

$$Sout = Z_s - K^{(n)} \cdot Z_d$$

where $Z_s$ and $Z_d$ are the complex signals of the summation channel and the difference channel, respectively. The signals are complex (rather than real) due to the fact that they are the outputs of discrete Fourier transforms of the signals. Thus, the above equation implies a frequency index, which is omitted for simplicity of notation. The iterations should be carried out individually for each frequency index, the frequency index corresponding to a particular frequency band of the discrete Fourier transformation. $K^{(n)}$ is a real parameter that is varied or adapted in step f), where n is the algorithm iteration index.

Furthermore, the bass-boost filter 20 phase shifts the subtraction output before being fed to the adaptive block 22. By choosing a proper frequency dependent phase shift constant, which is pre-calibrated using a simulation or measurements, it is ensured that K is a real parameter, which simplifies the following iterations significantly. On the n'th iteration of the algorithm (and for each frequency index), $K^{(n)}$ is updated according to the following expression using an auxiliary parameter $\tilde{K}^{(n)}$:

$$\tilde{K}^{(n)} = K^{(n-1)} + \gamma \frac{\mathrm{Re}\{Sout^* \cdot Z_d\}}{|Z_d|^2 + \alpha},$$

where Re denotes the real part and * denotes the complex conjugate. The optional small constant α is added for increased robustness of the algorithm, which helps when $Z_d$ is small. The step-size, γ, determines the speed of adaptation.

Finally $K^{(n)}$ is limited to a range, $$K^{(n)} = \begin{cases} K_{max} & \tilde{K}^{(n)} > K_{max} \\ K_{min} & \tilde{K}^{(n)} < K_{min} \\ \tilde{K}^{(n)} & \text{otherwise,} \end{cases}$$

where $K_{min}$ and $K_{max}$ are predetermined values that limit the angular direction of directivity pattern nulls and prevent these nulls from being located in certain regions of space. Specifically, the nulls may be prevented from being directed towards the mouth position of a user of the microphone system.

Not only the directions of the nulls are regulated by the adaptive filter, but also the overall characteristics and the number of nulls of the directivity pattern, which is influenced by the value of K. The characteristics may for instance change from an omni-directional pattern (when K is close to 0) to a cardioid pattern or to a bidirectional pattern, if the system is normalised to the far field. When normalised to a point in the near field, e.g. the mouth of a user, K=0 yields a characteristic similar to a cardioid, which is modified at high frequencies to attenuate sounds from all directions up to 3 dB or even more.

As previously mentioned, the microphone system is particular suitable for use in communication systems, such as a headset, where the spatial position of the source of the target sound signal, i.e. the speech signal from the user of the headset, is well defined and close to the first microphone 2 and the second microphone 4. Thereby, the frequency dependent phase matching of the target signal portions can be carried out with high precision. Furthermore, amplitude matching is needed to compensate for the difference between the first path length 27 and the second path length 28. This entails that the noise signal portions of the audio signals are run through the same amplitude matching, thereby making the noise signal portions even more predominant. However, this only makes it easier for the adaptive filter 22 to cancel out the noise.

FIGS. 2-5 show various embodiments of headsets utilising the microphone system according to the invention.

Figure 2:
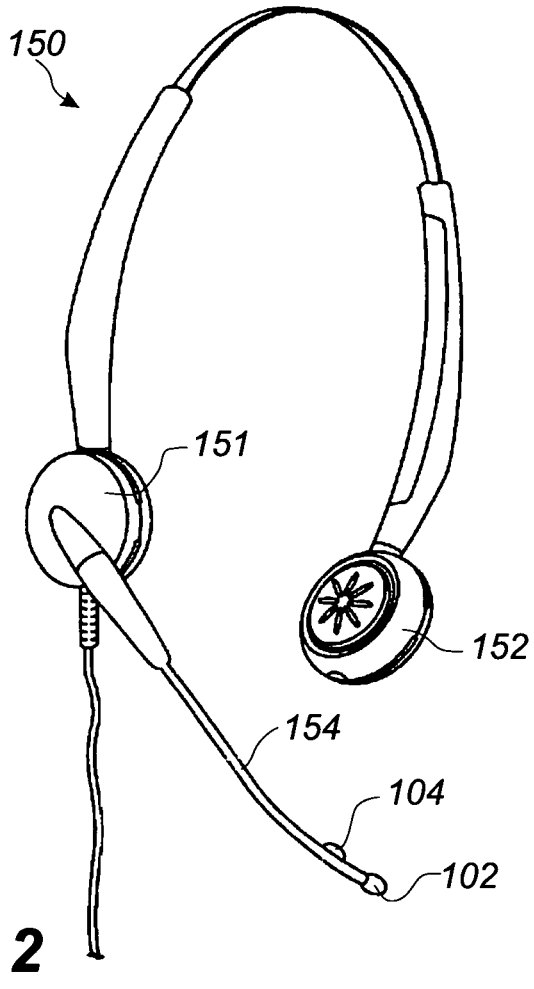
FIG. 2 is a first embodiment of a headset according to the invention and comprising a microphone system according to the invention.

FIG. 2 shows a first embodiment of a headset 150. The headset 150 comprises a first headset speaker 151 and a second headset speaker 152 and a first microphone 102 and a second microphone 104 for picking up speech sound of a user wearing the headset 150. The first microphone 102 and the second microphone are arranged on a microphone boom 154. The microphone boom 154 may be arranged in different position, thereby altering the mutual position between the mouth of the user and the first microphone 102 and the second microphone 104, respectively, and thereby the first path length and second path length, respectively. Therefore, the headset has to be pre-calibrated in order to compensate for the various settings. The headset 150 may be calibrated using measurements in various microphone boom 154 positions, and the settings for other microphone boom 154 positions can be extrapolated from these measurements. Thus, the headset 150 can change its settings with respect to the first processing means and/or the bass-boost filter and/or the adaptive block depending on the position of the microphone boom 154.

Alternatively, the headset may be provided with mechanical restriction means for restricting the microphone boom 154 to specific positions only. Furthermore, the headset may be calibrated for a particular user. Accordingly, the headset 150 may be provided with means for changing between different user settings.

The first microphone 102 and the second microphone 104 are arranged with a mutual spacing of between 3 and 40 mm, or between 4 and 30 mm, or between 5 and 25 mm. A spacing of 20 mm is a typical setting for a narrowband configuration and a spacing of 10 mm is a typical setting for a wideband setting.

Figure 3:
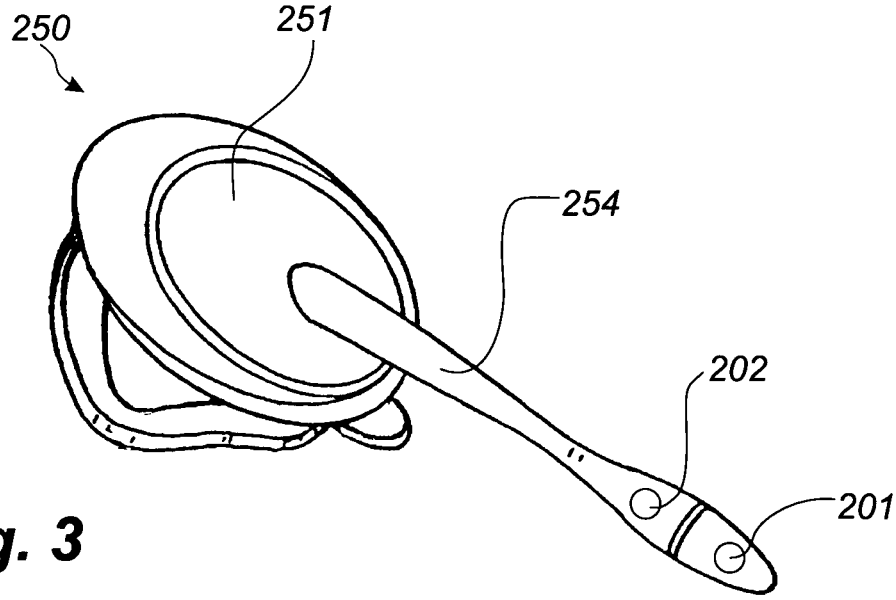
FIG. 3 is a second embodiment of a headset according to the invention.

FIG. 3 shows a second embodiment of a headset 250, where like numerals refer to like parts of the headset 150 of the first embodiment. The headset 250 differs from the first embodiment in that it comprises a first headset speaker 251 only, and a hook for mounting around the ear of a user.

Figure 4:
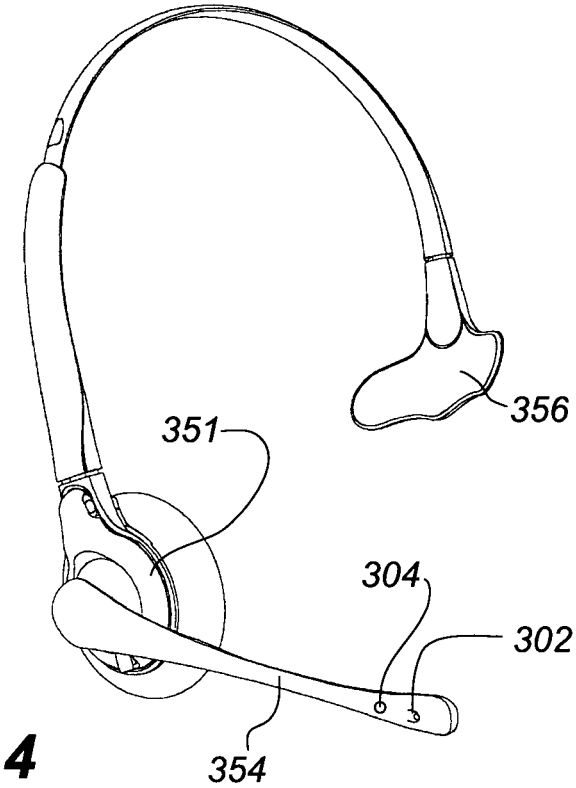
FIG. 4 is a third embodiment of a headset according to the invention.

FIG. 4 shows a third embodiment of a headset 350, where like numerals refer to like parts of the headset 150 of the first embodiment. The headset 350 differs from the first embodiment in that it comprises a first headset speaker 351 only, and an attachment means 356 for mounting to the side of the head of a user of the headset 350.

Figure 5:
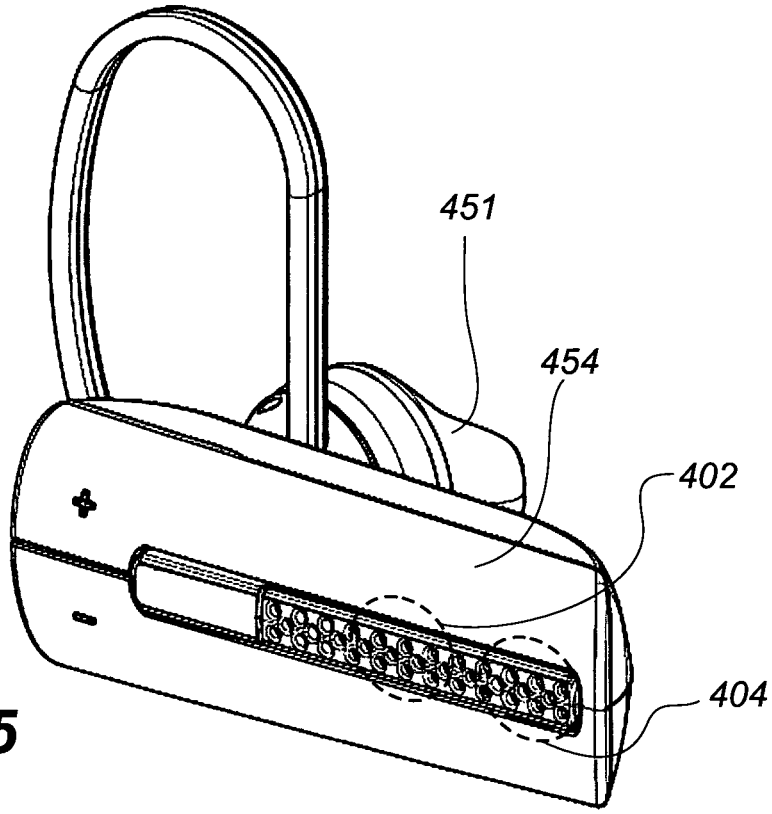
FIG. 5 is a fourth embodiment of a headset according to the invention.

FIG. 5 shows a fourth embodiment of a headset 450, where like numerals refer to like parts of the headset 150 of the first embodiment. The headset 450 differs from the first embodiment in that it comprises a first headset speaker 451 only in form of an earplug, and a hook for mounting around the ear of a user.

The examples have been described according to advantageous embodiments. However, the invention is not limited to these embodiments. The noise dosimeter can for instance be used with or be integrated in any type of headset, such as a headset as shown in FIG. 9 being similar to the ones shown in FIGS. 6 and 7 but having only one speaker, or a headset as shown in FIG. 8 with only one speaker and a hook for mounting on the ear of the user.

The examples have been described according to advantageous embodiments. However, the invention is not limited to these embodiments.

LIST OF REFERENCE NUMERALS

In the numerals, x refers to a particular embodiment. Thus, for instance 201 refers to the earpiece of the second embodiment.

2 first microphone
4 second microphone
6 first processing means/spatial matching filter
8 summation means
10 first subtraction means
12 first forward block/summation channel
14 multiplication factor
16 multiplication means
18 second forward block/difference channel
20 bass-boost filter
22 adaptive filter
24 second subtraction means
26 target source
27 first path length
28 second path length
x02 first microphone
x04 second microphone
x50 headset
x51 first speaker
x52 second speaker
x54 pickup unit/microphone boom

The invention claimed is:

1. A method of improving the signal to noise ratio of a user's voice captured by a microphone in a headset comprising the steps of combining two audio signal, by a) measuring a sound signal at a first spatial position using a first transducer in the headset, in order to generate a first audio signal comprising a first target signal portion including the user's voice and a first noise signal portion, b) measuring the sound signal at a second spatial position using a second transducer, in order to generate a second audio signal comprising a second target signal portion including the user's voice and a second noise signal portion, c) processing the first audio signal in order to phase match and amplitude match the first target signal with the second target signal within a predetermined frequency range and generating a first processed output, wherein the first audio signal processed by using a pre-calibrated matching filter in order to phase match and amplitude match the first target signal with the second target signal within a predetermined frequency range, wherein the matching filter is pre-calibrated to a predetermined geometry of transducers and the target source of the user, d) calculating the difference between the second audio signal and the first processed output in order to generate a subtraction output, by using an adaptive filter having an adaptive parameter, e) calculating the sum of the second audio signal and the first processed output in order to generate a summation output, f) processing the subtraction output in order to minimise a contribution from the noise signal portions to the system output signal and generating a second processed output, and g) calculating the difference between the summation output and the second processed output in order to generate the system output signal.

2. A method according to claim 1, wherein, in step f), the processing of the subtraction output is carried out by matching the noise signal portions of the subtraction output to the noise signal portions of the summation output.

3. A method according to claim 1, wherein, in step f), the processing of the subtraction output is controlled via the system output signal, optionally carried out by regulating a directivity pattern.

4. A method according to claim 1, wherein, in step c), the first audio signal is processed using a frequency dependent spatial matching filter.

5. A method according to claim 4, wherein the spatial matching filter is adapted for matching the first target signal portion with the second target signal portion towards a target point in a near field of the first microphone and the second microphone.

6. A method according to claim 5, wherein the distance between the target point and the first and second microphone, respectively, is 15 cm or less.

7. A method according to claim 1, wherein the subtraction output, in step f), is filtered using a bass-boost filter.

8. A method according to claim 1, wherein the subtraction output, during step f), is phase shifted with a frequency dependent phase constant.

9. A method according to claim 1, wherein the summation out-put prior to step g) is multiplied with a multiplication factor, alternatively the first audio signal and the second audio signal are weighted using weighting factors.

10. A method according to claim 1, wherein, in step f), the subtraction output is regulated using a least mean square technique.

11. A microphone system for use in a headset having a user microphone the microphone having a system output signal (Sout) and comprising:

a first microphone (2) for collecting sound and arranged at a first spatial position, the first microphone (2) having a first audio signal as output, the first audio signal comprising a first target signal portion and a first noise signal portion, and —a second microphone (4) for collecting sound and arranged at a second spatial position, the second microphone (4) having a second audio signal as output, the second audio signal comprising a second target signal portion and a second noise signal portion, characterised in that the system further comprises:

a first processor (6) for phase matching and amplitude matching the first tar-get signal portion to the second target signal portion within a predetermined frequency range, the first processing means (6) having the first audio signal as input and having a first processed output, the first processor including a pre-calibrated matching filter W for phase matching and amplitude matching the first target signal portion to the second target signal portion within a predetermined frequency range, wherein the matching filter W is pre-calibrated with respect to a pre-defined geometry of the microphones and a target source of the user;

a first subtraction means (10) for calculating the difference between the second audio signal and the first processed output and having a subtraction output, —a summation means (8) for calculating the sum of the second audio signal and the first processed output and having a summation output, a first forward block (12) having a first forward output and having the summation output as input, a second forward block (18) having the subtraction output as input and having a second processed output, the second forward block (18) being adapted for minimising a contribution from the noise signal portions to the system output signal, a second subtraction means (24) for calculating the difference between the first forward output and the second processed output and having the system output signal (Sout) as output.

12. A microphone system according to claim 11 , wherein the second forward block comprises an adaptive block, which is adapted for regulating a directional pattern.

13. A microphone system according to claim 11, wherein the second forward block is controlled via the system output signal (Sout).

14. A microphone system according to claim 11, wherein the second forward block is controlled using a least mean square technique.

15. A microphone system according to claim 11, wherein the first micro-phone (2) and the second microphone (4) are omnidirectional microphones.

16. A microphone system according to claim 11, wherein the first processing means (6) comprises a frequency dependent spatial matching filter.

17. A microphone system according to claim 11, wherein the second forward block (18) comprises a bass-boost filter.

18. A microphone system according to claim 11, wherein the second forward block (18) comprises a phase shift block for phase shifting the output from the first subtraction means (10).

19. A microphone system according to claim 11, wherein the first forward block (12) comprises a multiplication means (16) for multiplying the summation output with a multiplication factor (14), alternatively the summation means (8) comprises weighting means for weighting the first audio signal with a first weighting coefficient and the second audio signal with a second weighting coefficient.

20. A headset comprising at least a first speaker (151, 251, 351), a pickup unit (154, 254, 354), such as a microphone boom, and a microphone system according to claim 11, the first microphone (102, 202, 302) and the second microphone (104, 204, 304) being arranged on the pickup unit (154, 254, 354).

21. A headset according to claim 20, wherein a directivity pattern of the microphone system comprises at least a first direction of peak sensitivity oriented towards a user's mouth, when the headset is worn by the user.

22. A headset according to claim 21 , wherein the directivity pattern comprises at least a first null oriented away from the user, when the headset is worn by the user.

23. A headset according to claim 22, wherein the orientation of the at least first null is adjustable.

24. A headset according to claim 20, wherein the headset comprises a number of separate user settings for the filter means.

25. A headset according to claim 24, wherein the headset is adapted to automatically change the user settings based on a position of the pickup unit.

26. A headset according to claim 20, wherein the first microphone (102, 202, 302) and the second microphone (104, 204, 304) are arranged with a mutual spacing of between 3 and 40 mm, or between 4 and 30 mm, or between 5 and 25 mm.

* * * * *